US005209099A

United States Patent [19]

Saunders

[11] Patent Number: 5,209,099

[45] Date of Patent: May 11, 1993

[54] DRAW-PROCESS METHODS, SYSTEMS AND TOOLING FOR FABRICATING ONE-PIECE CAN BODIES

[75] Inventor: William T. Saunders, Weirton, W. Va.

[73] Assignee: Weirton Steel Corporation

[21] Appl. No.: 490,781

[22] Filed: Mar. 8, 1990

Related U.S. Application Data

[63] Continuation-in-part of Ser. No. 831,624, Feb. 21, 1986, Pat. No. 5,014,536, which is a continuation-in-part of Ser. No. 712,238, Mar. 15, 1985, abandoned.

[51] Int. Cl.[5] ..... B21D 22/22

[52] U.S. Cl. ..... 72/349; 72/350

[58] Field of Search ..... 72/347, 349, 330

[56] References Cited

U.S. PATENT DOCUMENTS

| | | | |
|---|---|---|---|
| 3,494,169 | 2/1970 | Saunders | 72/350 |
| 3,855,862 | 12/1974 | Moller | 72/349 |
| 4,036,056 | 7/1977 | Saunders | 72/350 |
| 4,414,836 | 11/1983 | Saunders | 72/348 |
| 4,485,663 | 12/1984 | Gold et al. | 72/347 |
| 4,584,859 | 4/1986 | Saunders | 72/349 |
| 4,685,322 | 8/1987 | Clowes | 72/349 |
| 5,014,536 | 5/1991 | Saunders | 72/348 |

FOREIGN PATENT DOCUMENTS

| | | | |
|---|---|---|---|
| 59-225830 | 12/1984 | Japan | 72/350 |
| 220209 | 6/1968 | U.S.S.R. | 72/350 |

*Primary Examiner*—Lowell A. Larson
*Assistant Examiner*—Donald M. Gurley
*Attorney, Agent, or Firm*—Raymond N. Baker

[57] ABSTRACT

New tooling technology for deep drawing one-piece can bodies from flat-rolled sheet metal can stock (58) which is precoated on both surfaces with an organic coating and draw lubricant. A draw die curved-surface cavity (122) entrance is formed using a radius of curvature (132) with a practical maximum of about five times nominal sheet metal thickness gage; and, preferably is formed about multiple radii of curvature ($R_L$, $R_S$, $R_L$) to increase surface area (140) without increasing projection on the clamping plane. Die cavity wall (156) is tapered about 1° to provide increasing cross section with increasing penetration of draw punch (160). Redraw die (90) has a sleeve-like configuration in a cross sectional plane which includes its central longitudinal axis (70); such configuration enables increase in production rate by enabling coaxial relative movement of such die into work product registry (98, 99) which position cups for redraw. The outer juncture (168) of such die sleeve is also formed about multiple radii of curvature (174, 180); and, the clamping space, between respective planar surfaces (96, 104) of die (90) and clamping ring (101) is tapered so as to decrease in vertical cross section in approaching die cavity (62).

23 Claims, 8 Drawing Sheets

DRAW-PROCESS METHODS, SYSTEMS AND TOOLING FOR FABRICATING ONE-PIECE CAN BODIES

This application is a continuation in part of copending application Ser. No. 831,624, "Drawn Can Body Methods, Apparatus and Products" filed Feb. 21, 1986, now U.S. Pat. 5,014,536 which was a continuation in part of U.S. application Ser. No 712,238, "Drawn Can Body Methods, Apparatus and Products" filed Mar. 15, 1985 (now abandoned).

This invention relates to new tooling, tooling systems and methods for draw-process fabrication of one-piece sheet metal can bodies; and more particularly, is concerned with draw-processing flat-rolled sheet metal which has been precoated while in coil form on both of its planar surfaces with an organic coating and draw lubricant (approved for canning comestibles) into one-piece can bodies for direct use in the assembly of sealed cans.

Specific aspects of the invention are concerned with new tooling systems, tooling configurations and materials, and fabricating methods for increasing productivity of deep-drawn finished can bodies in a single processing line. "Deep-drawn" refers to can bodies with side wall height significantly exceeding lateral cross section, for example, in which side wall height exceeds the diameter in a plane perpendicularly transverse to the centrally located axis of a cylindrical configuration can body. Draw processing in a single line refers to a line in which precoated flat rolled can stock is introduced and the product of that line is one-piece can bodies ready for direct use as fabricated for assembly into sanitary cans—free from any requirement for coating repair or washing or any such can body surface treatment of the fabricated can body prior to filling and, a line in which no off-line processing or surface treatment of any portion of such can body is required in order to prepare it for such usage.

Demands to supplant side-seams in cans for food products have been increasing for more than a decade. However, complexities of production, and especially the added steps in the finishing stages, have diminished the opportunity for either conventional draw-redraw and/or drawn and ironed can bodies to be economically competitive with three-piece sanitary can practice, especially in the can heights which are popular for packing fruits, vegetables, soups, and the like.

The performance characteristics of can bodies of the present invention enable competitive manufacture of draw-processed can bodies with side wall heights as required for such popular sizes; and, also, enable use for vacuum and/or pressure packs. New tooling configurations and coaxially interfitting tooling system relationships increase can body productivity rates without detriment to the sheet metal substrate or protective coating.

These and other advantages and contributions of the invention are considered in more detail in describing embodiments of the invention shown in the accompanying drawings while also setting forth prior art background; in such drawings.

Conventional redraw technology for fabricating one-piece can bodies relied on "nesting" of curved clamping surfaces (as seen in the cross sectional views of FIGS. 1 and 2) to both the inner and outer curved surfaces at the juncture between the endwall and side wall of a work product during reshaping of such work product.

Figure 1:
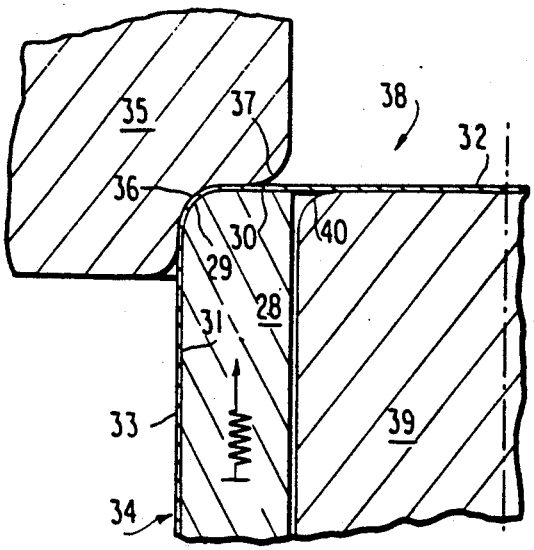
FIG. 1 PRIOR ART
FIG. 1 is a schematic cross-sectional partial view of conventional draw-redraw tooling which relies on nested curvilinear surfaces for sheet metal clamping.
Figure 2:
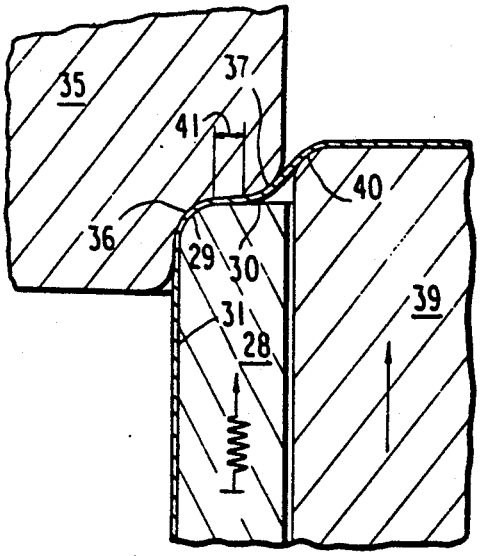
FIG. 2 PRIOR ART
FIG. 2 is a schematic cross-sectional partial view at a stage subsequent to that of FIG. 1.

In the conventional redraw apparatus of FIGS. 1 and 2, clamping ring 28 presents a curved transition zone 29 between endwall 30 and cylindrical side wall 31. The attempt was made to match clamping surface 29 to the internal surface at the juncture between endwall 32 and side wall 33 of drawn cup 34. Also, redraw die 35 had a curved surface 36 for clamping the exterior surface at the juncture between endwall 32 and side wall 33.

However, the thickness of the side wall sheet metal increases when using conventional draw-redraw technology and, such thickening of the side wall metal increases the difficulty in attempting to match curved clamping surfaces. The provisions for achieving significant uniformity of clamping force, which are basic contributions of the present invention, were absent in such prior draw-redraw practice.

Also, attempting to overcome such side wall thickening problem of the prior draw-redraw practice by forcing the side wall thickened work product (while mounted on a mandrel) through a smaller diameter ironing ring added other problems.

Other guidelines for conventional draw-redraw practice relate to curvilinear surface for a draw or redraw die cavity entrance (such as "37" seen in cross section in FIGS. 1 and 2 in a plane which includes the centrally located axis of the can body) which was made as large as possible without wrinkling the sheet metal during movement of a punch (such as "39" into the die cavity 38 of FIG. 2). And, further, to the curvilinear surface at the "nose" portion 40 of punch 39 which was made as small as possible without causing "punch-out" of metal at the start of reshaping.

Typical radius of curvature dimensions for such surfaces for using conventional draw-redraw tooling for a first redraw operation, in preparation for forming a 211×400 can (2-11/16" diameter by 4" height), would have been:

| | |
|---|---|
| clamping ring surface "30" | .125" |
| cavity entrance surface "37" | .070" |
| "punch-nose" surface "40" | .125" |
| draw die surface "26" | .135" |

However, use of conventional draw-redraw technology for producing single redraw sheet metal can bodies (with diameter greater than side wall height) increases side wall metal gage in excess of 15% above sheet metal starting gage in approaching the open end of the can body; and for deep-drawn can bodies whose side wall height exceeds diameter, such thickness increase in the side wall near the open end can exceed 25 to 30%.

Figure 3:
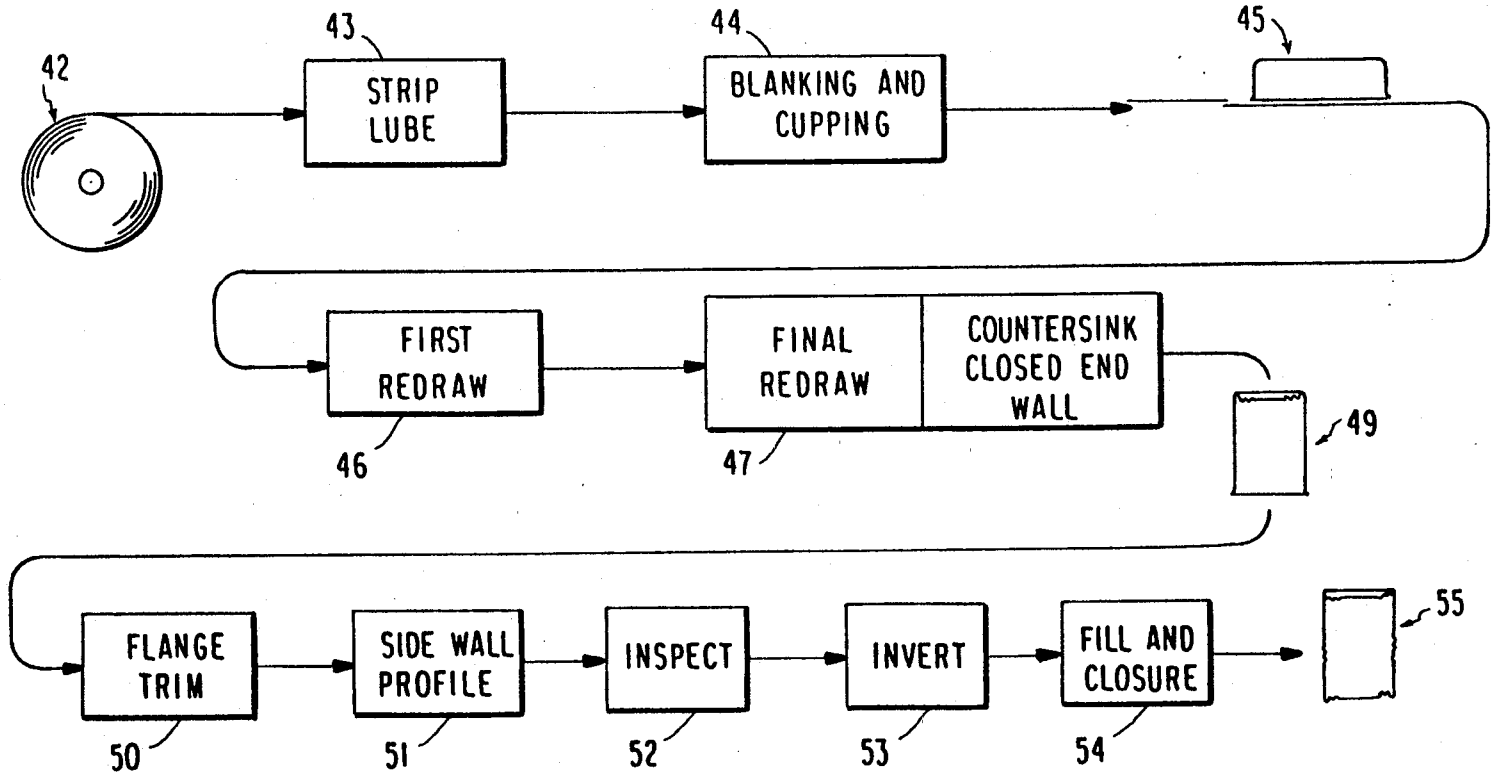
FIG. 3 is a diagrammatic presentation for describing the overall process steps and apparatus combination of the invention for single line fabrication of one-piece can bodies ready for direct use, as fabricated, in the assembly of two-piece cans.
Figure 4:
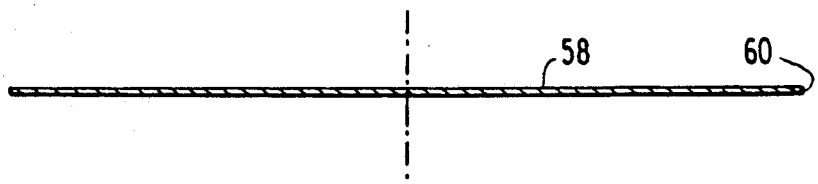
FIG. 4 is a cut edge view of a blank cut from precoated flat-rolled sheet metal as used in FIG. 3.

However, with solely planar clamping and other teachings of the present invention, thickening of sheet metal along the longitudinal direction of the side wall can be eliminated as a concern in the fabrication of one-piece deep-drawn can bodies from precoated sheet metal. It has been found that side wall thickness gage can be controllably decreased, so as to improve metal economics, without detriment to coating or substrate while producing a side wall which is also of more uniform gage about its full periphery at various levels along its height In the production of deep-drawn can bodies in the single-line system shown in FIG. 3, can stock of predetermined gage, precoated on both its planar surfaces with organic coating and draw lubricant, is introduced in coil form for can body fabricating. The draw lubricant can be embodied, at least in part, in the organic coating as delivered from coil 42; or, draw lubricant can be applied or augmented at station 43 using an atomized form of draw lubricant. Any requirement for surface lubrication in the fabricating line subsequent to station 43, notwithstanding multiple redraws, has been eliminated by tooling teachings of the present invention.

At station 44 a blank is cut from the can stock; and, a large-diameter, shallow-depth cup-shaped work product 45 is formed. Such blanking and cupping can be carried out on a single press.

An important aspect of the draw processing of the invention is the provision of flange metal at the open end of the work product. Such flange metal is oriented in a plane which is at or near perpendicularly transverse to the centrally located axis of the work product so as to be properly oriented for travel in-line and for chime seam formation in subsequent can assembly.

The cup-shaped work product 45 travels open end down on its flange metal to a subsequent redraw station or plurality of redraw stations. Two redraw stations are illustrated; however, regardless of whether "final" can body shape is the result of single or multiple redraw operations, the invention enables bottom profiling of the closed endwall of the can body in the same press where the final draw process shaping of the can body is carried out.

Each draw shaping is carried out to provide flange metal; and, preferably, is carried out with open end down orientation which protects interior cleanliness and provides for travel on flange metal thus protecting other more critical can body surfaces From first redraw station 46 (FIG. 3) the work product travels open end down on flange metal to final redraw and bottom-profiling station 47. Profiling of the closed endwall of the can body is carried out at station 47 with draw-punch tooling at "top-dead-center" of its relative movement within the die cavity and upon release of clamping forces on the flange metal.

The redrawn can body 49, with bottom wall profiling, then continues in line to flange trim station 50. The flange metal is properly oriented for trimming in which the configuration of the trim conforms to side wall configuration; and, is carried out by a plurality of blades shaped to that configuration; such shaped blades are rotated such that trimming takes place when cutting edge motion is in a direction which is tangentially parallel to the centrally located axis of the can body; such apparatus is described in more detail in U.S. Pat. No. 4,040,836 and is available from Standun Canforming Division of Sequa Corporation of Rancho Dominquez, Califorinia.

The can body travels in line to side wall profiling station 52. Side wall profiling can be carried out using eccentrically-mounted rolls in apparatus which is commercially available; for example, from Metal Box Limited, Reading RGI 3JH England. The can body is inspected at station 54; pin-hole detection apparatus using electromagnetic radiation is available commercially; for example, from Borden, Inc., Randolph, N.Y. Inspected can bodies are inverted to open-end-up orientation at inverting station 53 and directed (with no requirement for washing or other surface treatment) to filling and closure station 54 to provide a sealed two-piece can 55. In the alternative, all or a portion of the can bodies can be accumulated for future filling or shipment prior to being inverted at station 53.

Should the draw process of the invention be used for carbonated beverage can bodies, which presently call for endwall closures significantly smaller than the cross section presented by the can body side wall, flange metal is vertically oriented, or trimmed off, and the open-end is necked-in; metal at the open end is then reoriented to form a flange suitable for sealing such a smaller end closure to the can body.

The advantages of the invention are attainable for fabricating can bodies for the standard sanitary can sizes shown or described in "Dewey and Almy Can Dimension Dictionary", published by the Dewey and Almy Chemical Division, W. R. Grace & Co., Cambridge, Mass. 02140. However, press size and force requirements for extended-length stroke (above e.g about five and one-half inches) and exceptionally large lateral cross-section dimensions (e.g. above about five inches for the diameter of a cylindrical can); and, also, the relatively small quantitative demand for such extended height and large cross-section cans tends to establish a range considered to be more commercially practical for the near-term. Representative tooling dimensions and relationships for the more popular standard can sizes with maximum cross-sectional dimension (e.g. diameter) in the range of about one inch to about four and one quarter inches with side wall heights in the range of about one inch to about five inches are therefore provided herein.

With present teachings, processing of precoated sheet metal is carried out using a die cavity having an entrance zone surface selected to be as small as practicable while avoiding "cutting" of metal. For example, the radial dimensions of such cavity entrance zone as projected onto a plane perpendicularly transverse to the centrally located axis is selected to be about five times sheet metal substrate starting gage; and, to have a practical maximum value of about 0.04" for the above recited range of standard can sizes and sheet metal gages.

Regardless of the can configuration (cylindrical, oval or oblong) a compound curvature surface is used for at least a portion of the die cavity entrance zone. Herein, "compound curvature" refers to a surface which in cross section is curvilinear in a plane which is transverse to the centrally located axis and also curvilinear in a plane which includes such centrally located axis.

In accordance with present teachings, the entire entrance zone around the die cavity (draw or redraw) is specially formed utilizing multiple radii; also, a significantly larger "punch-nose" surface (between the endwall and side wall of the male plunger) is used than that taught by conventional draw-redraw technology. For example, the radius of curvature for punch nose surface 59 (FIG. 5) should be about forty times sheet metal starting gage for drawing a cup from blank 58. The size of the punch-nose surface taught herein can be partially dependent on lateral cross sectional dimension of the cup being drawn or redrawn. In the first draw for fabricating a work product for a 211×400 cylindrical can (2 and 11/16" diameter and 4" height) from precoated 65#/bb flat-rolled steel, punch nose radius 59 is selected at 0.275"; and, that radius of curvature is practical for the range of the more frequently used can sizes set forth above. As redrawn cross section decreases, the redraw punch transition zone radius can be decreased to about 0.2"; and, final redraw punch nose radius can be determined by requirements of the bottom wall configuration in the range of about 0.05" to 0.2".

Also as taught herein, the can stock substrate is preselected for high tensile strength characteristics, preferably established by work hardening. A representative example is the product of two stage reductions as applied during cold rolling, without a subsequent anneal. The result of such practice is commonly referred to as "double-reduced" in the flat rolled steel industry; this term is used with any of the so-called "tin-mill products" such as blackplate or TFS of 60 lb/bb or lighter (to 40 lb/bb nominal 0.0044" to 0.0066" as defined in Making, Shaping and Treating of Steel ©1964 by United States Steel Corporation, pages 951, 1194, 1195 and 1197 and typically provides a tensile strength in the range of 85,000 to 100,000 psi which is the desired range for present purposes. Such high tensile strength characteristics are important for purposes of providing the necessary tensile strength to withstand the side wall stretch-forming techniques of the invention; such characteristics also help to avoid undesirable changes in work-hardness of the sheet metal during work product shaping and reshaping.

The cut edge (periphery) 60 of blank 58 is predetermined by dimension and configuration; the former being relative to can body size; the latter to can configuration; as is known, a circular cut edge is provided for a cylindrical configuration can body.

Figure 5:
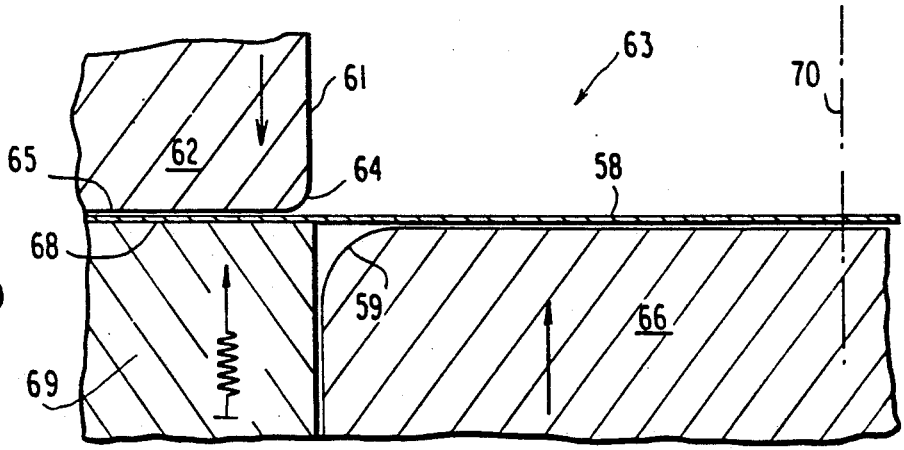
FIG. 5 is a schematic cross-sectional partial view of tooling for draw forming such blank in accordance with the invention into a one-piece cup-shaped work product with flange metal about its open end.

As shown in the partial cross-sectional schematic view of FIG. 5, internal side wall 61 of draw die tool 62 defines cavity 63; cavity entrance zone 64 is between draw-die internal side wall 61 and a planar endwall surface 65.

Single station blanking and cupping presses are readily available commercially. For the open-end-down, flanged work product, draw processing taught herein in which the work product is delivered directly onto the pass line from each draw forming operation, double-acting, opposed-ram presses are preferred; and such presses are available from Standun Canforming Division of Sequa Corporation located at Rancho Dominquez, Califorinia.

With cut blank 58 in position, relative movement of, or force applied by, the tooling is as indicated. The relative movement of draw punch 66 is into die cavity 63 as blank 58 is clamped about its periphery, which, as shown, is exterior to draw punch 66; such can stock is clamped between draw die surface 65 and surface 68 of clamping member 69. Both such planar clamping surfaces for cupping are perpendicularly transverse to the centrally located axis 70 (FIG. 5) which is the centrally located axis for cup-shaped work product 45 (FIG. 6); such axis remains as the common centrally located axis for subsequent work product and the draw and redraw tooling as aligned for and during draw processing usage. The draw die cavity entrance zone 64 is formed about multiple radii as described in relation to later figures (14, 15). Such tooling members are, in accordance with present teachings, formed from sintered machinable tooling materials.

Figure 6:
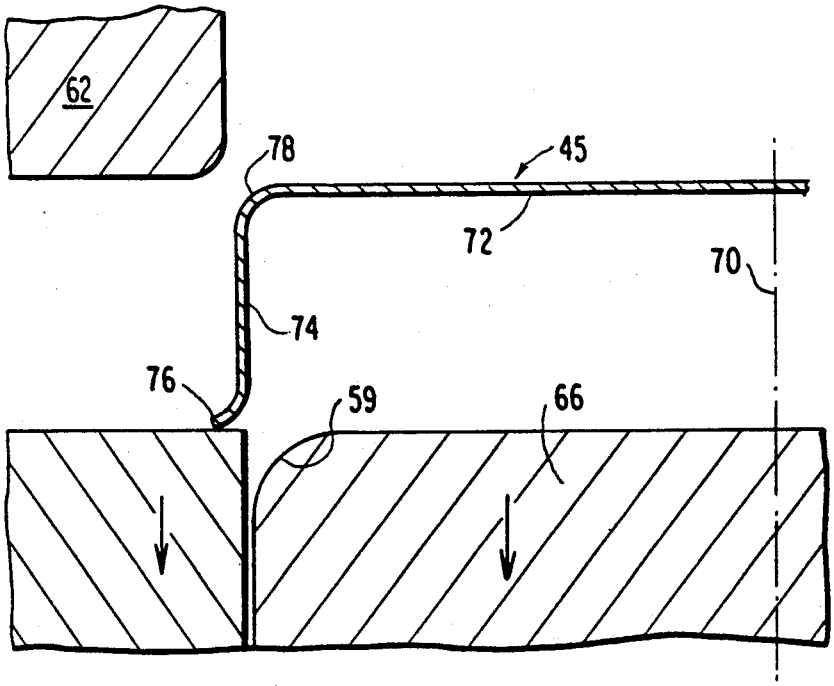
FIG. 6 is a cross sectional view of such drawn cup work product with flange metal as completed and ready for delivery open-end down for travel in line.

Drawn work product 45 (FIG. 6) includes endwall 72, side wall 74 which is symmetrically spaced from centrally located axis 70, flange metal 76 which lies in a plane which is at or near perpendicularly transverse to centrally located axis 70, and a curvilinear juncture 78, between endwall 72 and side wall 74. Juncture 78 has a curvilinear configuration conforming to that of punch nose 59 (FIGS. 5, 6).

The prior nesting arrangement of curved clamping surfaces (FIGS. 1 and 2) is eliminated. Also, the curvilinear surface juncture between the endwall and side wall of a drawn work product is first reshaped in a manner which significantly increases the surface area of the metal available for planar clamping between the planar surfaces presented during redraw; and, also, in a manner which creates an outwardly directed force on the can stock to prevent wrinkling of the coated sheet metal during such reshaping.

Figure 7:
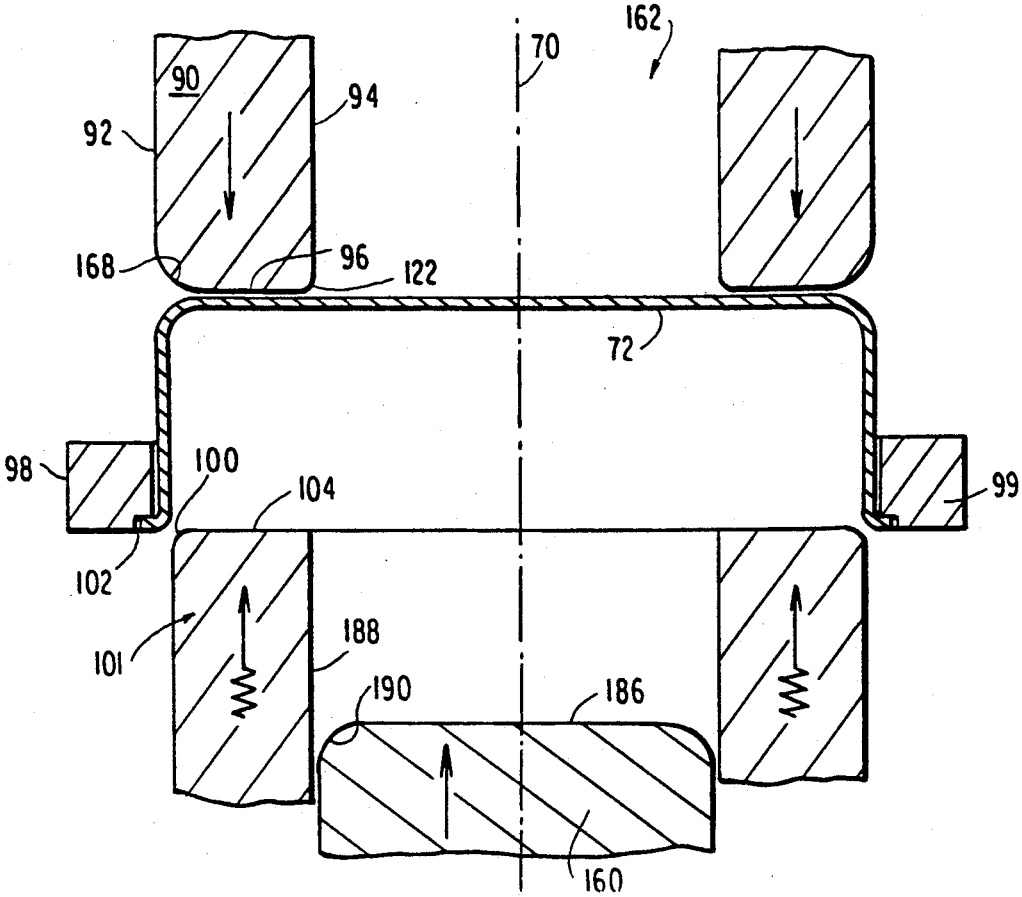
FIG. 7 is a schematic cross-sectional view arrangement, before start of redraw, for describing new interfitting tooling system concepts in accordance with the present invention.

Referring to FIG. 7, redraw die 90 in accordance with present teachings, presents outer side wall 92, inner (cavity) side wall 94 and intermediate planar endwall 96. A special coaxial relationship is established with work product registry means 98, 99 (which include recess means for flange metal on drawn work product) and also with other redraw tooling members; note that all tooling members are symmetrically disposed in relation to centrally located axis 70.

Initially, before other draw processing stages, juncture 78 of work products 45 is reshaped. The curvilinear transition zone 100 of tubular redraw clamping member 101, coacting with redraw die 90, reshapes such juncture 78 as shown in FIGS. 8, 9, 10 and 11.

The surface area of curvilinear transition zone 100 of redraw clamping member 101 is significantly smaller than the curvilinear surface area of juncture 78 of work product 45; i.e. a projection of the transition zone 100 onto a clamping plane which is perpendicularly transverse to the centrally located axis 70 occupies significantly less area and measures less in a plane which includes such centrally located axis; as taught herein, zone 100 is typically less than about 40% of the corresponding dimension measured as a projection of work product juncture 78 on such plane. Such reshaping of juncture 78 by transition zone 100, as shown in FIGS. 8–11, thus significantly increases planar clamping surface area; such increase in planar clamping surface is indicated by dimension 103 of FIG. 11.

Figure 10:
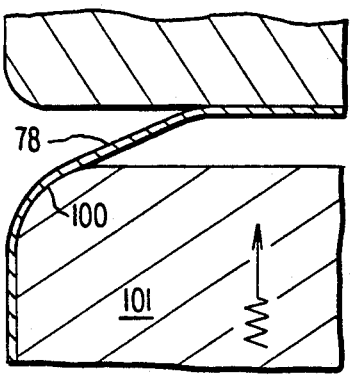
Figure 11:
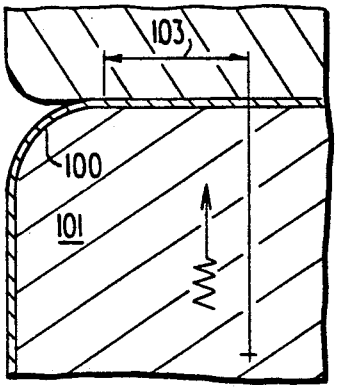

Clamping force of redraw clamping member 101 is controlled, preferably by pneumatically or hydraulically controlled pressure, with relative movement of the tooling establishing contact of transition zone 100 with the inner surface of work product juncture 78; a peripherally directed force is exerted on the endwall 72 of work product 45 as curved juncture 78 is reshaped to a smaller curved surface as seen in FIGS. 10 and 11. Upon completion of such reshaping, the precoated sheet metal is clamped solely between planar clamping surfaces (FIGS. 16, 17) during draw processing of the invention.

Clamping takes place, over an extended planar surface area, between redraw die endwall surface 96 (FIG. 7) and redraw endwall surface 104 of the redraw clamping member 101; that is, the total increase in planar clamping surface area due to such controlled reshaping of juncture 78, as indicated by cross sectional dimension "103" of FIG. 11, extends around the full clamping area between planar such surfaces 96, 104.

In a specific embodiment, a 0.275" radius of curvature at cup juncture 78 projects on a clamping plane which is perpendicularly transverse to the centrally located axis as 0.275"; the projection of transition zone 100 on the same plane occupies 0.071"; thus an increase of about 75% in planar clamping surface, as projected onto a plane which is at or near perpendicularly transverse to such centrally located axis, results.

Figure 8:
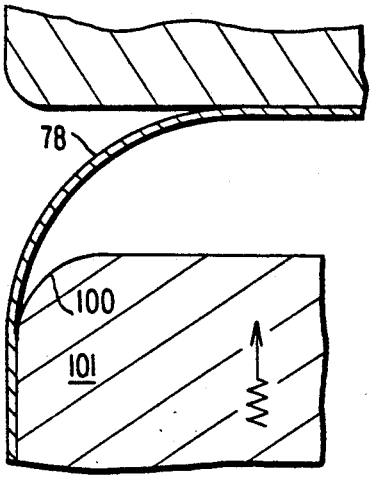
FIGS. 8–11 are enlarged cross-sectional partial views of redraw clamping tooling and work product for describing reshaping, in accordance with the invention, of the curvilinear juncture between the endwall and side wall of a drawn work product in order to increase planar clamping surface for redraw.
Figure 9:
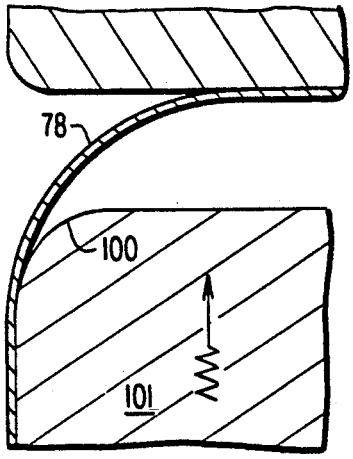

Also, forming such clamping member transition zone, indicated by "100" of FIGS. 8, 9 and 10, about multiple radii rather than a single radius of 0.071" further increases the planar clamping surface area. Manufacture in accordance with such multiple radii concept is described in relation to the enlarged view of FIG. 12. A single radius of curvature for the redraw clamping member transition zone 100 about a radius "R" would result in a projection on such a perpendicularly transverse clamping plane dimensionally equal to "R". In place of such single radius, a multiple radii surface is provided through selective usage of "large" and "small" radii of curvature in forming the curvilinear transition zone for the tubular redraw clamping member 101.

Figure 12:
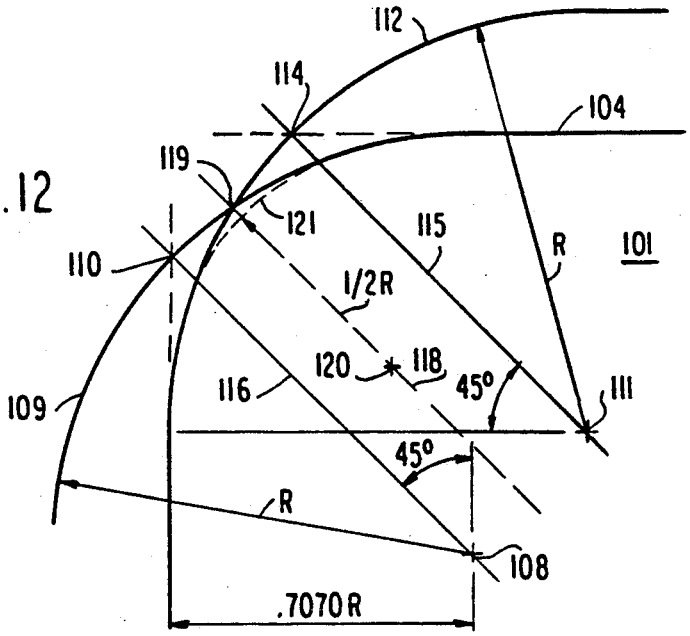
FIG. 12 is an illustration for describing manufacture of a multiple radii surface for use in FIGS. 8–11.

Clamping member 101 of FIG. 12 includes planar endwall 104 and external side wall 106. In preferred fabrication of a multiple-radii transition zone between endwall 104 and side wall 106, a radius R ("large") is used about center 108 to establish circular arc 109 which extends into tangency with the endwall surface 104. Circular arc 109 intersects the extended plane of external side wall 106 at imaginary point 110. Using the radius R about center 111 establishes circular arc 112 tangent to side wall 106; arc 112 intersects the extension of transverse endwall 104 at imaginary point 114. Straight line 115 is drawn between point 114 and center 111; straight line 116 is drawn between point 110 and center 108; line 118 is drawn to be equidistant between parallel lines 115, 116. Line 118 comprises the loci of points for the center of the "small" radius of curvature which will be tangent to the circular arcs 109 and 112 so as to avoid an abrupt intersection such as would occur at imaginary point 119. Using a "small" radius of ½ R with its center 120 along line 118, tangential circular arc 121 is drawn to complete a smooth multiple-radii curvilinear juncture in place of the single radius juncture for clamping member 101.

As a result of the multiple-radii configuration of FIG. 12 for zone 100, the projection on the transverse clamping plane is 0.0707 times R; thus resulting in a further increase in the planar clamping surface area over that available if a single radius (R) were used for curvilinear transition zone 100; this bringing the total increase in planar clamping surface closer to 80%. Also, a more gradual curvilinear surface 112 is provided from the side wall 106; and a more gradual curvilinear surface 109 is provided in the transverse clamping area. More gradual curvatures are thus also provided on the internal surface of the curvilinear juncture 78 for the cup-shaped work product 45 as side wall metal 74 of such work product changes its orientation during redraw; other improvements at the entrance to and in the clamping space are described later herein.

In a specific embodiment for a multiple-radii redraw clamping ring transition zone for reshaping a 0.275" radius of curvature for work product 45, R is selected to be 0.100"; therefore the projection of the clamping ring multiple-radii transition zone on the transverse clamping plane comprises 0.0707"; rounded off as 0.071". Other values for R can be selected, e.g. 1.25" for reshaping a cup juncture of substantially greater radius than 0.275"; or 0.9" for reshaping a smaller radius of curvature juncture; in general selecting R as 0.100" will provide desired results throughout the preferred commercial range of can sizes designated.

Figure 16:
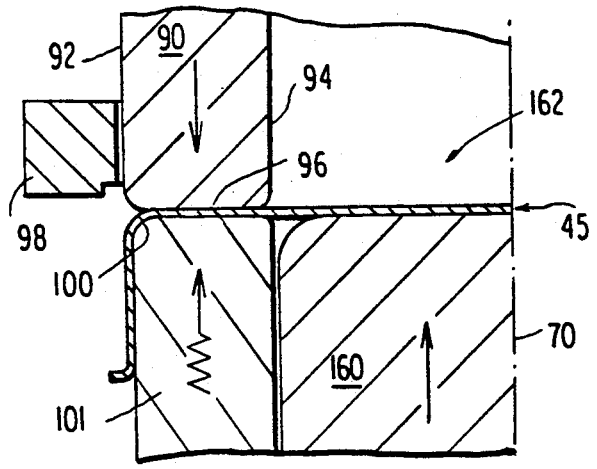
FIGS. 16 and 17 are schematic, cross-sectional, enlarged partial views of the redraw tooling system of the present invention for describing the interfitting relationships enabling faster production rate redrawing of can bodies.
Figure 17:
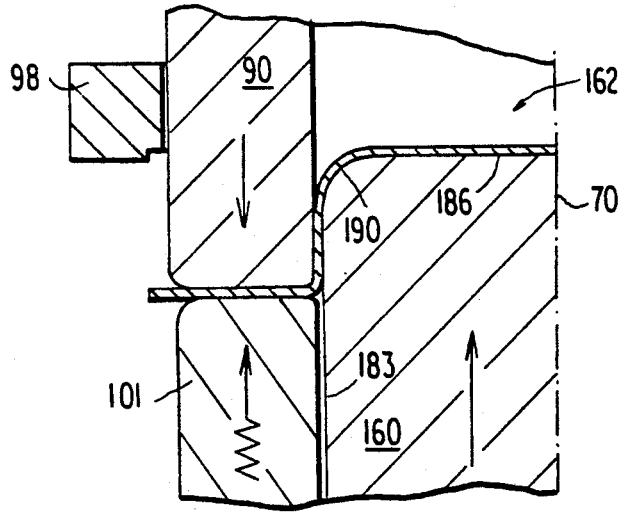

Further, the invention teaches die entrance zone modifications in which the cavity entrance zone 64 (FIG. 5) for draw die 62 and cavity entrance zone 122 (FIG. 7) for the tubular-configuration redraw die 90 are formed about multiple radii; these and additional die configurational modifications are described with reference to FIGS. 13, 14 and 15. Such new configurational modifications as applied to a redraw die, such as "90" of FIGS. 7, 16 and 17, provide for gradual changes of direction for the sheet metal which facilitate desired movement of precoated metal from the clamping space into the side wall during draw-processing; and, also for support of such metal during such movement so that the metal is not in an uncontrolled state during draw processing reshaping.

The novel tooling configurational concepts for cavity entrance surfaces of draw and redraw dies help to overcome the sheet metal inertia encountered in starting the simultaneous multi-directional movement of precoated flat-rolled sheet metal which must take place during work product draw processing. Difficulties in overcoming such inertia of the can stock during initiation of such multi-directional shape changes are minimized and damage to coating or substrate is avoided while enabling more than doubling the stroke rate previously available with conventional draw-redraw technology.

These objectives are accomplished while maintaining the concept of a small surface area cavity entrance zone, as represented by a projection of such zone onto a plane at or near perpendicularly transverse to the centrally located axis; measurement of the cross sectional dimension in a plane which includes the cross sectional axis indicates the value of such projection; such dimension has a practical maximum of about five times nominal sheet metal starting gage for either the draw or redraw die cavity entrance zone.

The reshaping of sheet metal in accordance with the invention is carried out with work product side wall metal being stretched under tension between the "punch nose" surface and the cavity entrance zone while providing a die cavity interior side wall surface which avoids interference with the can stock and eliminates any adherence of can stock, or smearing of coating, along such die cavity interior side wall surface; in addition, the redraw clamping area is specially shaped as describer later therein.

Thus damage to can body side wall coating is avoided notwithstanding increasing reshaping stroke rates more than twice that previously available with conventional draw-redraw tooling. Also, with the new configurations and sinter-hardened machinable tooling material surface wear on the tooling or the need for refinishing of tool surfaces appears to have been substantially eliminated.

Providing a cavity entrance surface formed about multiple radii increases surface area for supporting the precoated sheet metal in the cavity entrance zone (as described below in relation to FIGS. 13, 14 and 15) and provides a more gradual change in direction of movement of the coated sheet metal which facilitates overcoming inertia of sheet metal during both draw and redraw operations. Better support for the can stock is provided both during its movement into and from the cavity entrance zone and is accomplished without diminishing planar clamping surface area; that is, the projection of the curvilinear cavity entrance zone on the transverse clamping plane is not increased by the multiple radii concept as applied to such zone.

Figure 13:
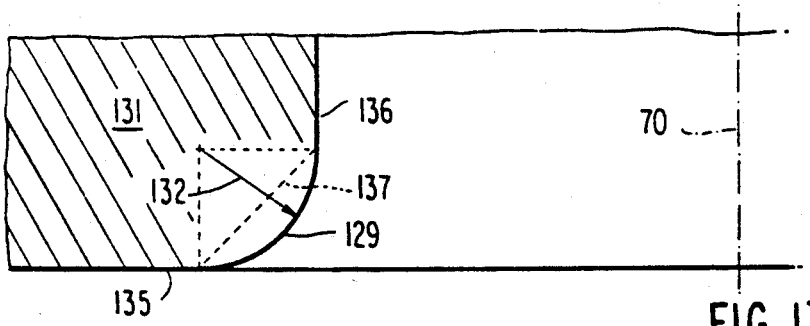
FIGS. 13–15 are schematic, cross-sectional, partial views for describing draw and redraw die configurations for the cavity entrance between the interior side wall and planar endwall of each such die as taught by the present invention.

FIG. 13 shows an enlarged view of a single-radius cavity entrance surface 129 between contiguous portions of die 131, which is representative for both draw and redraw dies. Single radius 132 (as taught earlier) was selected to provide smaller surface area than the typical radius used in conventional draw-redraw technology. Such single-radius curvilinear surface 129 extends between planar endwall surface 135 and internal side wall 136; and is tangential, at each end of its arc rate ends (as shown in a plane which includes centrally located axis 70) to endwall surface 135 and cavity side wall 36, respectively.

The surface area of a cavity entrance zone is increased in a manner which will provide for a more gradual movement of the can stock both into and out of the entrance zone so as to help overcome the inertia within the sheet metal which tends to resist multi-directional reshaping action, imposed by draw processing.

Figure 14:
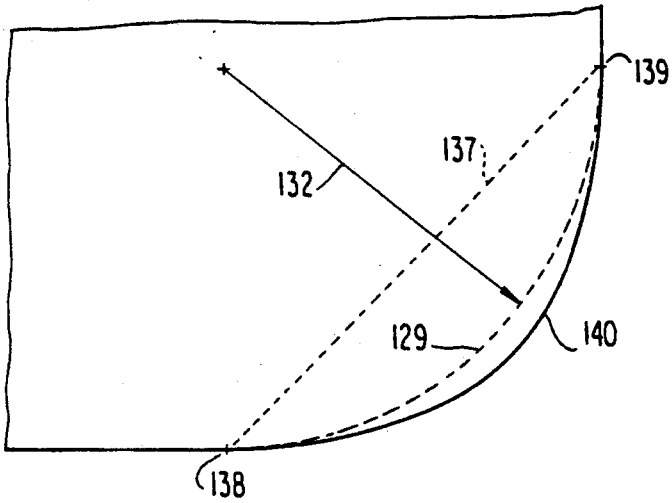

In the further enlarged view of FIG. 14, the curvilinear surface 129 (about single radius 132 of FIG. 13) is shown as an interrupted line; also, line 137 at an angle of 45', between the planar endwall surface and cavity side wall, is shown as an interrupted line; such 45' angle line 137 meets the respective points of tangency of a single radius surface 129 at the same endwall surface and internal side wall points of tangency 138 and 139, respectively. An increased area curvilinear surface 140 for the entrance zone is shown in FIG. 14. Comparison to single-radius surface 129 shows that surface 140 provides for a more gradual movement of the can stock as discussed earlier. The multiple-radii concept for such increased surface area of the cavity entrance zone is illustrated by FIG. 15. In a specific embodiment, a radius equal to or greater than 0.04" is selected as the larger radius ($R_L$) for the multiple-radii surface Such larger radius ($R_L$) provides for such more gradual movement into and out of the cavity entrance zone, as shown, while maintaining tangency with endwall and side wall surfaces.

Figure 15:
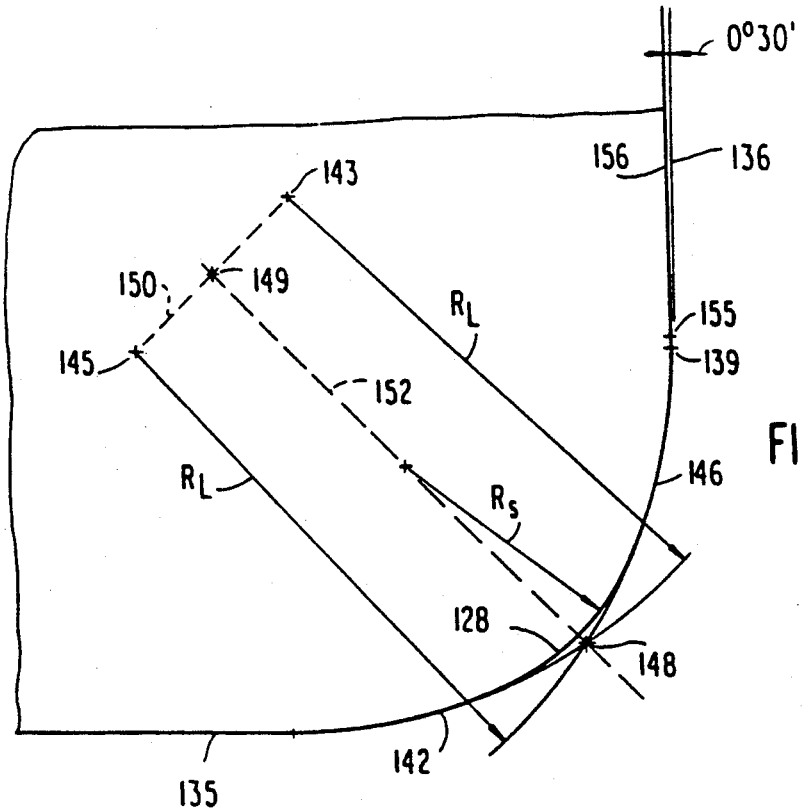

A smaller radius ($R_S$) is used to establish a curvilinear surface intermediate such larger radius ($R_L$) arcuate end portions 142, 146; that is, $R_S$ forms the centrally located curvilinear surface area shown at 128 of FIG. 15.

This multiple-radii, increased-surface-area concept and a recess-tapered concept for the cavity side wall are shown in FIG. 15. Portion 142 of the combined curvilinear surface 140 is formed about center 143 using larger radius $R_L$ (0.04" and above); such surface portion 142 is tangential to the planar endwall surface 135. Such larger radius is also used about center 145 to provide curvilinear surface 146 leading toward the internal side wall of the cavity.

To derive the loci of points for the centrally located smaller radius ($R_S$) of the central portion of the combined curvilinear surface, the arcs of the larger radii surfaces 142, 146 are extended to establish an imaginary point 148 at their intersection. Connecting imaginary point 148 with midpoint 149 of an imaginary line 150 between the $R_L$ centers 143,145 provides the remaining point for establishing the loci of points (line 152) for the center of the smaller radius ($R_S$) of curvature; the latter will provide the curvilinear surface 128 which is tangential to both larger radius ($R_L$ curvilinear surfaces 142 and 146.

Typically, for the can sizes and materials discussed above, the larger radius ($R_L$) of curvature would be 0.04" and above, in the range of 0.040" to 0.060", and the smaller radius ($R_S$) of curvature would be less than 0.040", e.g. in the range of 0.020" to 0.030". For example, an increased curvilinear surface area entrance zone for can stock of about 0.007" gage, for which a single-radius of curvature of about 0.028" would provide a suitable entrance zone, would be formed with an $R_L$ of 0.040" and an $R_S$ of 0.020". The projection on the clamping plane would remain at 0.028".

In such multiple-radii configurations, the smaller radius ($R_S$) curvilinear surface occupies at least about ⅓ of the compound curvilinear surface area, is located intermediate the larger $R_L$ surfaces and, is the contact edge for tension stretching of the side wall metal. In the $R_L$=0.040", $R_S$=0.020" embodiment, the $R_S$ curvilinear surface occupies slightly in excess of 37% of the total surface area of a 90° arc between the clamping surface and internal side wall of the draw die; and, each of the $R_L$ surfaces would occupy slightly less than 32% of the surface area in such a 90° arc.

However, in order to provide about one degree (between about one-half degree and one and one-half degrees) of recessed taper for the cavity internal side wall, the arc at the transition zone (normally 90°) is increased at the side wall by about one degree (corresponding to the amount of taper desired). Such increase in the arc enables the internal side wall to be recess tapered in the same amount with such side wall surface being tangent to the curvilinear zone surface at point 155; i.e. about one-half degree beyond the 90° point of tangency at 139. Such slightly recess-tapered internal side wall is shown at line 156 in relation to a non-tapered side wall surface indicated by line 136. With such configuration, the side wall of the work product is stretched between the "punch nose" and cavity entrance zone during draw and redraw operations without interference from the cavity side wall.

Figure 23:
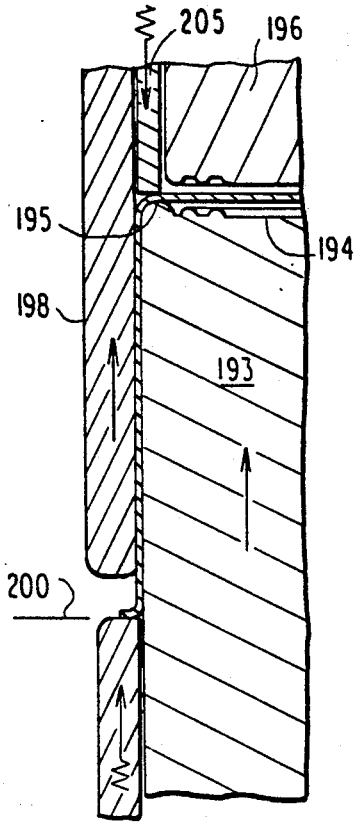
FIGS. 23, 24 and 25 are schematic, cross-sectional, partial views of redraw and endwall profiling tooling of the invention which completes redraw and provides profiling of the closed endwall in the same station.

Other configurational enhancements of the tooling and tooling system are described in relation to FIGS. 7, 16 and 23. One of these relates to a coaxial interfitting arrangement for the new tooling system which eliminates the prior need to mechanically move the cup alignment registry means (used for positioning a drawn cup accurately in relation to the redraw tooling of the press station) for redraw; another relates to modifying the clamping space, and entrances to such clamping space, in order to facilitate the movement of metal into the clamping space so as to maximize planar clamping surface contact with the can stock between the redraw die endwall and the tubular redraw clamping member endwall during redraw; and, also, to improve side wall gage uniformity around the full periphery of the side wall.

In order to overcome a prior requirement to move the registry means from the redraw station, the redraw die was redesigned to a tubular configuration. And, also, for carrying out the coaxial relationship concepts advanced for tooling members, registry means and work product, peripheral dimensions and configurations of the side wall of the work product (such as side wall 74 of product 45) the inner surface of registry arms 98, 99, and the clamping sleeve 101 (FIG. 7) are interrelated. Data covering such dimensional relationship is tabulated later herein. Registry inner surface means are symmetrically disposed with relation to centrally located axis 70 (as can be seen from registry arms 98, 99 of FIG. 18 for a cylindrical can body embodiment) and provide for rigidly holding a work product cup side wall. Also space is allowed for flange metal; see space 100 in registry arm 98, (FIG. 7) which provides for movement of a flanged work product into registry for redraw.

Figure 18:
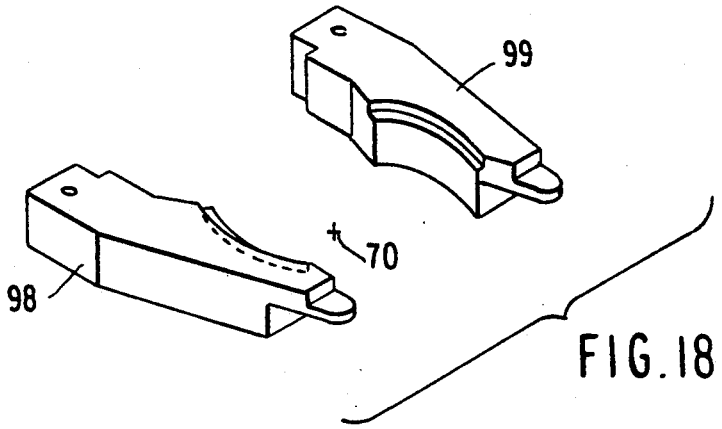
FIG. 18 is a perspective view of one embodiment of the work product registry means shown schematically in FIGS. 16 and 17.

As indicated by the registry arms 98, 99 of FIG. 18 for a cylindrical can body embodiment, such registry arms present inner surface means symmetrically disposed with relation to centrally located axis 70. Such inner surface means rigidly hold a work product cup side wall, while allowing space 100 for flange metal (FIG. 7, registry arm 100) as a flanged cup work product moves into registry for redraw. A pair of pivotally mounted arms is shown in the specific embodiment; other coaxial surface registry means could be used.

The tooling members move coaxially relative to each other and the registry means as indicated by FIGS. 7, 16, 17 and 18 with the relative movement of tubular redraw die 90 being driven downwardly, tubular clamping member 101 being pneumatically or hydraulically controlled to apply desired clamping force, and the relative movement of redraw punch 160 being into the die cavity 162.

The coaxial relative movement between redraw die 90 and redraw punch 160 is shown in FIG. 17 as the drawn work product is given a new side wall cross sectional dimension within draw die 90 and the metal, peripheral thereto, is clamped between redraw die endwall surface 96 and redraw clamping member endwall 104. In FIGS. 16, 17 the relative movement of redraw die 90 is in a direction indicated by the arrow into and within the registry arm 98; with no necessity for removal of registry means from the redraw station.

Figure 19:
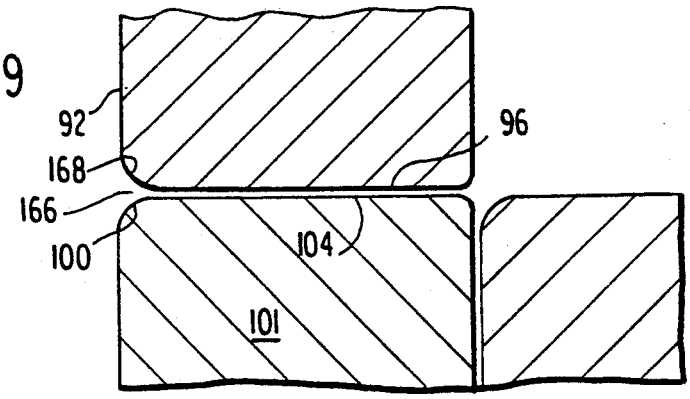
FIGS. 19 and 20 are schematic, cross-sectional, enlarged partial views for describing new redraw clamping space concepts of the invention.

The work product 45 is clamped between surfaces 96 and 104 which defines clamping space 166; a tapered (in cross section) character for such clamping space is a significant contribution of the invention; such tapered clamping space shown is in an exaggerated manner, for purposes of explanation in (FIG. 19). A smooth curvilinear-surfaced funnel-like approach into such tapered clamping space 166 is provided by curvilinear shaping of the peripheral (outer side wall) transition zone 168 (FIGS. 16, 17) of draw die 90 and, the earlier-described curvilinear transition zone 100 of clamping member 101. The curvilinear configuration provided at 168 avoids damage to the sheet metal or coating at the outer periphery of the tubular redraw die as differently-oriented parts (end wall portion, side wall end flange) of the previously drawn work products are drawn into the clamping space.

Figure 20:
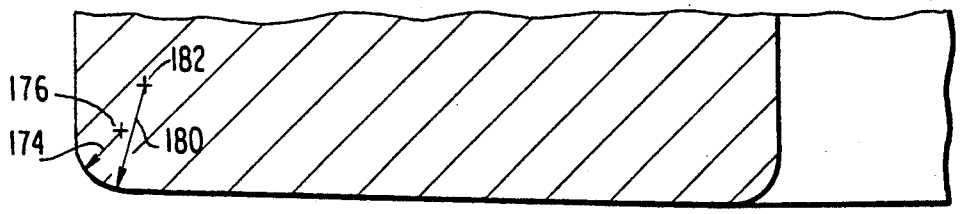

In order to facilitate entry into the tapered clamping space 166, transition zone 168 (FIG. 19) is formed about multiple radii between outer side wall 92 and endwall 96 of tubular redraw die 90. The surface of transition zone 168 is formed (as best seen in FIG. 20) about two radii; smaller radius 174 about center 176 forms a surface tangent to side wall 92; and larger radius 180 about center 182 presents a surface tangent to a plane at or near perpendicularly transverse to the centrally located axis.

The objective for the larger radius (180) surface about center (182) which is tangent to such transverse plane is to present a gradual surface which will not damage substrate or coating (as the can stock is pulled into the clamping space) while maintaining the maximum practical planar clamping surface for the draw die.

The object for the small radius (174) is to present a practical curvilinear surface (which will not damage substrate or coating) utilizing the smallest practical dimensions in such transverse plane.

Selective values for the embodiment described are:

| | |
|---|---|
| larger radius 180 | .085" |
| smaller radius 174 | .040" |

The center 182 for larger radius 180 is positioned 0.085" above the transverse plane along a 45° angle line at a location 0.060" ($0.085 \times \text{Sin } 45° = 0.060''$) from the outer side wall 92. The center 176 for smaller radius 174 is positioned 0.040" from outer side wall 92 so as to be tangent to side wall 92 and to this such surface of the larger radius 180.

As taught herein, tapered planar clamping space 166 is minutely wider at entrance to such clamping space in order to maximize planar clamping surface contact—notwithstanding any slightly thickened portion of the work product side wall or end wall metal which might be encountered during clamping. This slight tapering also avoids any tendency to damage such metal or coating. A taper which is a small fraction of a degree, such as about five minutes (0° 5') continues between the planar surfaces of such clamping space so as to decrease the cross sectional area there between, as viewed in a plane which includes the centrally located axis, in approaching the centrally located axis 70.

Such slight tapering has been found to be particularly helpful in maximizing surface contact with the tooling made from sinter-hardened machineable materials; sinter-hardened machineable tooling is formed from pulverant materials, e.g. carbides such as tungsten carbide, or ceramics such as FERRO-TIC© available from Alloy Technology International, Inc., Nyack, N.Y., hardened alumina, or nitrides such as the cubic form of boron nitride, and like materials. Such tapering of the clamping space helps to avoid damage to the coating or sheet metal substrate at high production rates (at or above 150 strokes/min.) as taught herein. In order to minimize the machining required in making the tooling, it is preferred to establish such tapered clamping space 166 by machining only the endwall surface 96 with such desired taper; as measured linearly, the surface is machined between about 0.005" and 0.012" per inch of clamping surface dimension as such surface is viewed in cross section in a plane which includes such centrally located axis.

Such tapering helps entry into and passage through the clamping space, helps to maximize planar surface contact and also helps to achieve more uniform side wall thickness gage about the full periphery of the side wall. Characteristics of the metal substrate enter into the latter; while partially dependent on cold rolling practice of the flat rolled sheet metal, it has been found that, in general, there is a tendency for the sheet metal to be elongated more, and drawn to a slightly thinner gage, at angles of about 45° to the rolling direction than the sheet metal which is in the rolling direction or at 90° to such rolling direction. That is, for cylindrical configuration can bodies the sheet metal at 45°, 135°, 225° and 315° in relation to the rolling direction would be slightly more elongated, and therefore slightly thinner, than the metal at 0°, 90°, 180° and 270° about the circumference of such side wall.

The slight tapering for the clamping space described maximizes planar surface contact with each draw; and, helps to make such side wall gage more uniform about the side wall periphery as such side wall metal is more uniformly clamped as it is stretched under tension, as taught herein.

Punch 160 includes endwall 186 and peripheral side wall 188 with curvilinear transition zone 190 therebetween. In contrast to the small projected area of a die cavity entrance zone, a large surface area is provided by "punch-nose" 190 (FIGS. 16, 17). Overcoming the inertia of starting a new diameter is facilitated by such selection of a relatively large surface area for punch-nose 190. Coaction between such large surface area punch-nose, a cavity entrance surface formed about multiple radii for more gradual curvatures, elimination of the prior art curved surface "nesting", and the better control of tension achieved by increasing the planar clamping surface area, as described above, combine to provide better direction and support for precoated metal during its draw processing movement and to provide better control of tensioning of side wall sheet metal to prevent increase in thickness gage; and also to enable more uniform stretching of the side wall sheet metal. Such controlled tensioning of side wall metal is carried out while avoiding damage to the organic coating or sheet metal substrate. "Organic coating" as used in the can industry to refers to any of the organic polymeric coatings such as vinyls, epoxys, polyesters and the like, or combinations thereof, which are applied in a solvent, or in a water-based form, or as a film, to sheet metal or sheet metal substrate. Such organic coatings are approved by governmental regulatory agencies, such as the U.S. Food and Drug Administration, and typical suppliers are The Valspar Corporation of Pittsburgh, Pa., Dexter Packaging Products of Waukegan, Ill., BASF Corporation of Clifton, N.J. and DeSoto, Inc. of Des Plaines, Ill.

As a result of use of the present invention, in addition to the more uniform side wall gage about the circumference of a can body side wall, which peripheral uniformity increases with each redraw, side wall thickness gage is controlled substantially throughout side wall height. Also the invention provides for avoiding to a substantial degree even minor increases in thickness in such longitudinal direction near the open end of the can body; or, the distal end of flange metal which is not placed under side wall tension stretching during any of the draw or redraw stages, notwithstanding that multiple redraws are carried out to form a deep-drawn can body (with side wall height significantly exceeding cross sectional dimension, such as diameter).

In contrast to the prior side wall thickening experience of 15%, and higher per draw near the open end of the can body with conventional draw-redraw practice, can body side walls of the invention can be decreased in thickness throughout the side wall height; with a decrease of about 25% occurring at mid-side wall height as shown in later tabulated data; or, control of side wall tension can be exercised to control side wall thinning to a lesser or greater extent while avoiding damage to coating or substrate.

In the specific embodiment for a 211×400 can, precoated 65#/bb double-reduced steel, the first-redraw punch-nose radius is selected to be about thirty times starting metal thickness gage; e.g. 205". The same multiple radii compound curvature which projects as 0.071" on the transverse clamping plane can be used, for convenience, in reshaping this compound curvature juncture (which has an internal surface radius of curvature of 0.205") during the second redraw; or a new surface based on R=0.9" can be used in forming the multiple radii transition zone for a second redraw tubular clamping member with tool movement as shown in (FIGS. 8–11).

Typical values for deep drawing a can body for a 211×400 size cylindrical can from precoated 65#/bb double-reduced flat-rolled steel from a 6.7" diameter cut-edge, circular blank are as follows:

| Projection of Ring Transition Work Product | Diameter | Punch-Nose Radius | Projection of Cavity Entrance Transition Zone | Clamp Zone |
|---|---|---|---|---|
| Shallow cup (first draw) | 4.4" | .275" | .028" | — |
| First-redraw .071" cup | 3.2" | .205" | .028" | |

-continued

| Projection of Ring Transition Work Product | Diameter | Punch-Nose Radius | Projection of Cavity Entrance Transition Zone | Clamp Zone |
|---|---|---|---|---|
| Second redraw .071" cup | 2.5" | .062" to .205" | .028" | |

Typical sheet metal clearance in each draw is approximately one and a half times sheet metal thickness or about 0.010" to 0.012" per side (in cross section) for precoated 65#/bb flat-rolled steel.

In practice of the invention, the sheet metal blank planar surface (e.g. the diameter of a circular blank) is decreased about 25% to 40% during cupping; or, the diameter of the side wall of such work product is decreased about 15% to 30% in each subsequent.

Typical diameters for a double-redraw can body embodiment for a cylindrical can size of 300×407 are:

| | |
|---|---|
| circular blank cut-edge | 7.6" |
| first draw side wall | 5.2" |
| first redraw side wall | 3.6", and |
| second redraw side wall | 2.9" |

Typical diameters for a single redraw embodiment (can size 307×113) are:

| | |
|---|---|
| circular blank cut edge | 6.2" |
| first draw side wall | 4.0" |
| redraw side wall | 3.3" |

Typical values exemplifying the interfitting relationships referred to earlier are as follows:

| | |
|---|---|
| redraw die 90 | |
| 0.D | 5.214" |
| I.D | 3.622" |
| contact surface at registry arms 98, 99 | |
| I.D | 5.214" |
| clamp ring 101 | |
| 0.D | 5.195" |
| punch 160 | |
| diameter | 3.600" |

Figure 21:
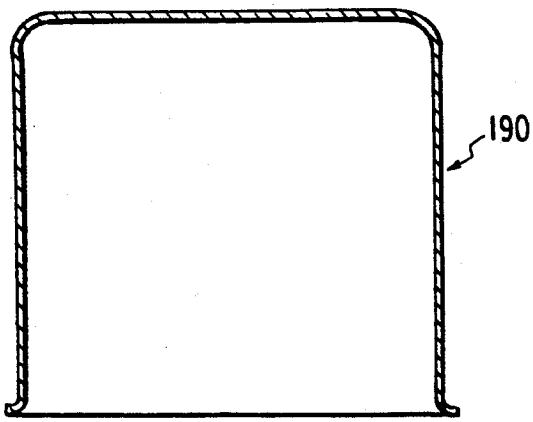
FIGS. 21 and 22 are cross-sectional views of intermediate redrawn work product for a specific embodiment of the invention.
Figure 22:
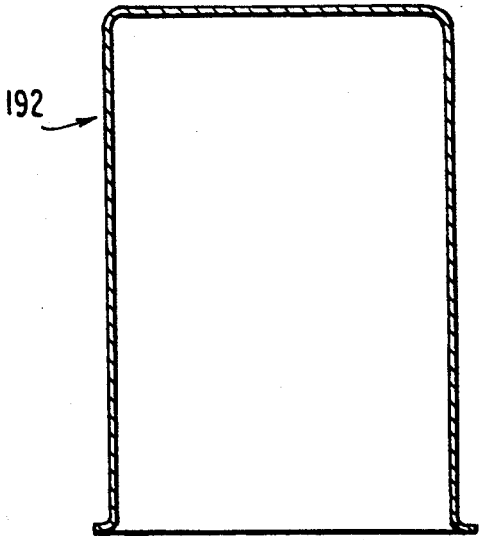
Figure 24:
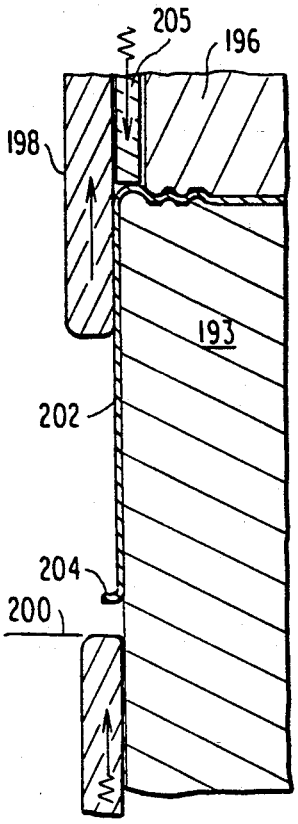
Figure 25:
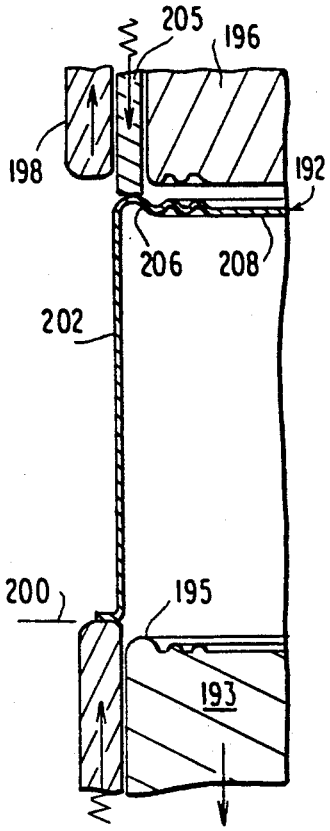
Figure 26:
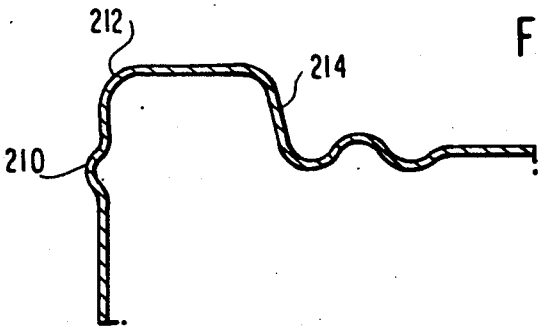
FIG. 26 is a cross-sectional, enlarged, partial view of a work product can body illustrating another configuration for an endwall profile.

Multiple redraws in excess of two can be made as part of the present invention. The punch nose radius of curvature in a final redraw can be selected based on requirements of can geometry; e.g. about ten times starting gage of the sheet metal can be used, depending on closed endwall profiling; while a value of twenty to thirty times starting gage would ordinarily be preferred A first redraw can body 190 is shown in FIG. 21 and a second redraw can body 191, as shown in FIG. 22, was redrawn with a punch nose having a radius of about 0.071". In each instance, flange metal at the open end of the can is oriented in a plane at or near perpendicularly transverse to its centrally located axis. Endwall profiling for such embodiment and discharge of the can body on the flange metal in the pass line are shown in FIGS. 23, 24 and 25. An endwall profile can providing for a larger punch nose radius, which will provide better access for the tooling to form side wall bead to match a later-added chime seam, is shown in FIG. 26.

When using conventional draw-redraw technology on tin-free steel, for a can body for a 211×400 can size, the average increase in side wall sheet metal thickness at the open end of a conventional double-redraw can body was about 17.5%. Measuring circumferentially-distributed average thickness, at about ¼" longitudinal increments over the entire side wall height dimension of a prior art can body side wall results in an average thickness about equal to starting gage. Whereas, with one embodiment of the present invention, such side wall thickness measurements average about 12.7% less than the starting gage. These data correspond to starting blank area requirements in practice of the present invention; the starting blank area can be selected to be at least 12% less with the present invention than the starting blank area requirement using conventional draw-redraw technology; e.g. in a specific embodiment of the invention for a can body for a 211×400 can size the starting blank diameter is 6.718"; the starting blank diameter for conventional draw-redraw technology was 7.267".

With conventional draw-redraw technology, the metal increases in thickness along the side wall height with such increase over starting gage reaching from about 15% to 25% at the open end of the draw-redraw can body. With the present invention, increase in thickness along the side wall can be substantially eliminated. However, a minor and limited portion of the can body contiguous to the distal end of open end flange metal may retain its original gage or sheet metal at such open end may be slightly thicker (about 2%) than the starting gage exhibited by the closed endwall. This may occur because the distal end of the flange is never put under side wall tensioning as flange metal is maintained through several draw shaping operations; and, increased thickening can occur near such open end with multiple redraws.

However, the present invention makes it possible to controllably decrease side wall gage over substantially full side wall height enabling improved metal economics while providing adequate vacuum and crush-proof strength for either vacuum or pressure pack uses. Side wall gages can be selected by selection of blank size and content of draw processing stretching by content of planar clamping pressure.

In specific embodiments of the invention, an organically-coated, TFS steel substrate was fabricated into can bodies (of the configuration shown in FIG. 25) for 211×400 cans utilizing a draw and first and second redraws; side wall gage was then measured at about 0.2" longitudinal increments (tabulated as "A" through "S") starting at the open end and proceeding longitudinally throughout the side wall height. The percentage change in side wall thickness, measured around the circumference at each such incremental level, is set forth in the Table below. In Example #1, side wall thickness increased only slightly (less than 3%) solely at the first measurement location ("A") contiguous to open end flange metal; decrease in thickness over side wall height averaged slightly less than 15%; in Example #2, side wall thickness decreases slightly at such location; average decrease in thickness slightly above 16%; in example #3, the average decrease in thickness gage is about to 14.1%. Percentage changes in side wall thickness gage are shown:

TABLE

| Side Wall Measurement Locations Starting at 0.2" from Flange Metal of FIG. 22 | Percentage Reduction Example #1 % | Example #2 % | Example #3 % |
|---|---|---|---|
| A | (2.2)* | 2.0 | 3.22 |
| B | 4.8 | 8.7 | 8.25 |
| C | 9.7 | 11.2 | 12.73 |
| D | 14.7 | 17.0 | 15.25 |
| E | 17.9 | 18.6 | 17.48 |
| F | 18.9 | 19.2 | 19.44 |
| G | 20.4 | 21.2 | 20.28 |
| H | 21.5 | 22.1 | 21.40 |
| I | 21.2 | 23.1 | 21.68 |
| J | 22.1 | 23.8 | 23.08 |
| K | 22.8 | 24.1 | 24.12 |
| L | 22.5 | 23.8 | 9.09 |
| M | 14.1 | 23.2 | 9.09 |
| N | 10.6 | 11.2 | 10.77 |
| O | 11.8 | 13.1 | 11.89 |
| P | 13.1 | 13.8 | 14.69 |
| Q | 14.4 | 14.1 | 14.96 |
| R | 13.8 | 14.4 | 4.90 |
| S | 7.4 | 4.1 | 5.46 |

*(Increase)

Profiling of the closed endwall is used with one-piece can bodies to accommodate the implosion effects of internal vacuum and/or the expansion effects of internal pressure which may be encountered during heating. In accordance with the present invention, endwall profiling is carried out after the final draw shaping as the flange is freed from clamping forces; clamp force is released so as to eliminate stress or strain on side wall or endwall metal during profiling. A preferred endwall profile uses the concepts described in U.S. Pat. No. 4,120,419 of Oct. 7, 1978 in which a portion of the endwall metal is shaped to permit flexing, toward the exterior or interior of the can, by a centrally-located panel portion of the endwall.

Referring to FIGS. 23, 24 and 25 the profiling of unitary endwall panel 192 (best seen in FIG. 25) is provided by the configuration of the final draw punch 193 coacting with the recessed endwall portion 194 of punch 193. The punch endwall portion 194 is recessed from peripheral edge portion 195 which defined a single plane endwall surface utilized during the draw shaping of the can body. FIG. 24 shows the coaction of endwall profiling mandrel 196 with the recessed punch endwall configuration 194 after clamping force has been released by withdrawal of draw die 198.

The pass line for can bodies is shown at 200. As endwall profiling is completed, can body 202 is repositioned (FIG. 25) at the pass line 200 on its flange metal 204. Spring loaded ejector 205, peripheral to profiling mandrel 196, returns can body 202 to the pass line.

The configuration of endwall panel 192, has a slanted wall portion 206 (FIG. 25) which is peripheral to central panel 208 and permits the latter to flex axially; e.g. toward the can body without disturbing upright stability of the can. Under vacuum conditions, the profiling angled wall 206 enables the panel 208 to move toward the interior of the can. This endwall concept utilizes less can volume than an interior dome-shaped profile; e.g. the normal four-inch height for a condensed soup can (211×400) can be decreased to a height of 3-15/16" through use of the drawn can body configuration of FIG. 25.

The cross sectional partial view of FIG. 26 depicts endwall profiling and a side wall bead 210 which is used in order to provide a uniform diameter can taking into account the chime seam customarily formed for sealing an endwall closure to the open end of the can body during assembly of sanitary can packs.

The endwall profiling of FIG. 26 enables a curvilinear transition zone 212 leading to flex-wall portion 214. This configuration allows easier access for eccentrically-mounted tooling used to form side wall bead 210. The endwall panel flex-wall portion 214, which is angled between the vertical and the horizontal helps to provide for the same flexing function as described earlier in relation to endwall panel 192.

Line handling equipment for can bodies and draw presses with which the present tooling and tooling system teachings can be utilized are available commercially, e.g. through Standun Canforming Division of Sequa Corporation of Rancho Dominquez, California.

While representative embodiments specifying can stock, tooling, work product and coating data and materials have been set forth in describing the invention, it should be recognized that those skilled in the art will be able to devise modifications to such embodiments in light of the above teachings; therefore, for purposes of determining the scope of the present invention, reference shall be had to the appended claims.

I claim:

1. Redraw tooling apparatus for redrawing a cup-shaped work product having a closed endwall, a cylindrical-configuration side wall and curvilinear surface transition zone unitary with such endwall and side wall drawn from flat-rolled sheet metal substrate coated with an organic polymeric coating and draw lubricant, comprising A. registry means for positioning the cup-shaped drawn work product in alignment for redraw, such registry means presenting a working surface which conforms to at least a portion of the external side wall configuration of the drawn work product, B. redraw tooling members, including (i) a redraw punch, (ii) a redraw die having a tubular, sleeve-like configuration, and (iii) a redraw clamping member having a tubular, sleeve-like configuration;

the registry means working surface and the redraw tooling members being symmetrically disposed in aligned relationship with a common central axis common with that of the drawn work product when positioned for redraw usage;

the redraw punch and clamping member being disposed as aligned for relative movement when positioned for such redraw usage toward the interior surface side of the drawn work product with the redrawn die toward the exterior surface side of the drawn work product;

the redraw die including (a) an inner side wall defining a centrally located redraw cavity which is symmetrically disposed in relation to the common central axis, (b) an outer side wall which is symmetrically disposed in relation to the common central axis with a cross sectional configuration, as viewed in a plane which is perpendicularly transverse to such common central axis so as to interfit coaxially within the work surface of the registry means, and (c) a redraw die endwall between such inner and outer redraw die side walls, such redraw die endwall presenting solely a planar clamping surface of predetermined surface area symmetrically disposed in relation to such common central axis about the redraw die cavity for coaction with the redraw clamping member located on the interior surface side of the drawn work product when positioning for such redraw usage, (d) a unitary curvilinear redraw die cavity entrance transition zone between such redraw die endwall and inner side wall, and (e) a unitary curvilinear outer periphery transition zone between such redraw die clamping surface and outer side wall, each such redraw die transition zone having a compound curvature surface so as to be curvilinear as viewed in cross section in both a plane which is perpendicularly transverse to and a plane which includes such common central axis;

the redraw punch presenting an external surface which is symmetrically disposed with respect to the common central axis and including (1) a redraw punch endwall presenting at least a peripheral portion which defines a plane which is perpendicularly transverse to such central axis, (2) a side wall having a cross sectional configuration and defining a cross sectional area in a plane perpendicularly transverse to such common central axis providing for relative movement of the redraw punch into the redraw die cavity while allowing for sheet metal and tooling clearances when positioned for redraw usage which decreases the cross-sectional area defined by the side wall in the range of about 15% to 30%, and (3) a curvilinear-surface punch transition zone unitary with the redraw punch endwall and side wall;

the redraw clamping member being unitary and presenting an outer side wall, an inner side wall, an endwall therebetween, and a curvilinear transition zone surface between the clamping member endwall and outer sidewall;

the redraw clamping member endwall presenting a planar clamping surface disposed in a plane transverse to the common central axis;

the redraw punch having an outer side wall cross sectional configuration with dimensional characteristics approximating those of the redraw clamping member inner side wall so to enable the punch to fit within such inner side wall while allowing for tooling clearance when positioned for redraw usage;

the transition zone for the redraw clamping member presenting a curvilinear surface having a compound curvature so as to be curvilinear as viewed in cross section in a plane which is perpendicularly transverse to such common central axis and in a plane which includes such common central axis;

the clamping member transition zone, as projected onto a plane which is perpendicularly transverse to the common central axis of the redraw tooling, occupying less than about 40% of a corresponding projection of the curvilinear juncture between the endwall and side wall of the drawn work product onto such perpendicularly transverse plane when positioned for redraw usage during which the curvilinear juncture of the drawn work product is initially reshaped to that of the redraw clamping member curvilinear transition zone, as the drawn work product is clamped outwardly of and contiguous to the redraw punch solely between the planar clamping surfaces of the redraw die and redraw clamping member to form a redrawn can body presenting (i) a closed endwall with at least a peripheral portion of its endwall defining a plane which is perpendicularly transverse to the common central axis of the redrawn can body, (ii) a side wall corresponding in cross sectional configuration corresponding in configuration and size to that of the redraw die cavity and defining a cross sectional area in a plane perpendicularly transverse to the common central axis of the redrawn can body which is in the range of about 15% to 30% less than the corresponding cross sectional area of the drawn work product, and having a uniform height extending from the closed endwall toward the axially opposite open end of the redrawn can body, and flange metal extending about the full periphery of the side wall of the redrawn can body at its open end, the flange metal being disposed at completion of the redraw usage in a plane which is at or near perpendicularly transverse to the common central axis of the redrawn can body, with the side wall height of the redrawn can body being greater than the side wall height of the drawn work product, and having a curvilinear juncture between the redrawn can body endwall and side wall, the redrawn can body curvilinear juncture having an interior surface area which is approximately equal to the surface area of the redraw punch curvilinear transition zone.

2. The apparatus of claim 1 in which the curvilinear surface of each transition zone interconnecting the redraw die planar endwall respectively with its outer and inner side wall is formed about multiple radii of curvature to present a gradual curvilinear smooth surface for redraw usage leading respectively into and out of the clamping area formed between the redraw die endwall and the redraw clamping member endwall.

3. The apparatus of claim 2 in which the inner side wall surface of the redraw die has a recess tapered configuration such that the redraw cavity defined by such surface increases in cross sectional area, as measured in a plane perpendicularly transverse to such common central axis, in progressing into the redraw die cavity from the redraw die entrance zone.

4. The apparatus of claim 3 in which the cross sectional area, defined between planar clamping surfaces of the redraw die and the redraw clamping member as viewed in a plane which includes the common central axis diminishes in progressing radially from the outer side wall of the redraw die and clamping member toward such central axis, with the angle defined between such planar surfaces being less than about five minutes.

5. The apparatus of claim 4 in which the planar clamping surface of the redraw clamping member is perpendicularly transverse to the common central axis, and the planar clamping surface of the redraw die is tapered to provide such diminishing cross sectional area between such planar surfaces.

6. The apparatus of claim 1 for use in multiple redraw can body fabrication in which the cross sectional area of the redraw punch curvilinear transition zone as projected onto a plane which is perpendicularly transverse to such common central axis is selected in relation to the cross sectional area of such redraw punch with a projection of the redraw punch curvilinear transition zone as measured along a plane which includes such common central axis having a dimension related to sheet metal substrate gage in the range of about 0.15 inch to about 0.30 inch, and the curvilinear surface at the redraw die cavity entrance zone as projected onto a plane perpendicularly transverse to such common central axis and measured in cross section in a plane which includes such central axis having a dimension related to sheet metal substrate gage in the range of about 0.02 inch to about 0.035 inch.

7. Apparatus for carrying out redraw of work product drawn from a circular cut edge blank of high tensile strength flat-rolled double-reduced steel can stock into a can body of increased side wall height in relation to the drawn work product, comprising in combination redraw tooling including a sleeve-like redraw die of tubular cross section a redraw punch, and a redraw clamping ring, each being symmetrically disposed during redraw usage for movement in relation to a common central longitudinal axis, and further including positioning means including surface means partially defining a cylindrical configuration for fixing the location of the drawn work product for redraw, the positioning means cylindrical configuration and size providing during redraw usage for relative movement of the redraw die in a direction parallel to the common central axis through the positioning means free of any requirement to move the positioning means from the redraw area during such redraw usage, the redraw die presenting:

a redraw cavity defined by an internal side wall, an outer periphery side wall, with both internal and outer periphery side wall being symmetrically disposed with relation to such central longitudinal axis and having a circular configuration in a plane perpendicularly transverse to such axis, the redraw cavity internal side wall being recess tapered in the amount of about one half degree so as to present a larger cross sectional area in a plane perpendicularly transverse to such central axis with increasing penetration into the redraw cavity, a redraw die endwall providing for solely planar clamping by presenting a redraw die planar clamping surface disposed to extend radially from the entrance zone of the redraw cavity in a plane which is perpendicularly transverse to the common central axis of the redraw die cavity, a unitary curvilinear redraw die cavity entrance transition zone between the redraw die end-wall and the redraw die cavity internal side wall, the redraw die planar clamping surface extending to a redraw die transition zone at the redraw die outer periphery side wall, the redraw die outer periphery side wall defining a cylindrical configuration conforming to that partially defined by the surface means of the positioning means to enable movement within such surface means during redraw usage, the redraw cavity entrance zone presenting a curvilinear surface between the redraw cavity internal side wall and the redraw die planar clamping surface, such cavity entrance curvilinear surface when projected onto a plane perpendicularly transverse to such central axis having a radius in the range of about 0.02" to about 0.035";

the redraw punch means including a substantially cylindrical configuration redraw punch which is symmetrical with respect to such central axis as aligned for redraw usage, an endwall having at least a peripheral portion defining a planar surface disposed in a plane which is perpendicularly transverse to the common central axis of the redraw punch, a side wall having a circular configuration in a plane perpendicularly transverse to such central axis and a diameter providing for sheet metal clearance during redraw usage so as to provide for relative movement of the redraw punch into such redraw cavity in which the diameter of the drawn work product is decreased in the range of about 15% to about 30%, and a compound curvilinear transition zone of predetermined surface area between the redraw punch endwall and side wall;

the redraw clamping ring presenting a circular toroidal configuration in a plane perpendicularly transverse to such central axis which is symmetrically disposed for and during redraw usage in coaxial relationship with, and radially exterior of, the redraw punch, the toroidal configuration redraw clamping ring presenting a planar endwall clamping surface disposed in a plane perpendicularly transverse to such central axis;

a substantially cylindrical configuration outer peripheral side wall, symmetrical to such central axis and having a diameter which for redraw usage is approximately equal to the internal diameter of a drawn work product side wall while allowing for tool clearance, and a curvilinear-surface transition zone for such redraw clamping ring between its planar endwall clamping surface and its outer periphery side wall surface, such redraw clamping ring transition zone as projected onto a clamping surface plane which is perpendicularly transverse to such central axis for redraw usage occupying less than about 40% of the projection of the curvilinear-surface juncture, between the endwall and side wall of the drawn work product, onto such clamping surface plane such that during redraw usage the dimension relationship provides for the curvilinear juncture at the closed end of the drawn work product to be initially reshaped to that of the redraw clamping ring curvilinear-surface transition zone with can stock sheet metal which is radially outward of and contiguous to the redraw punch being clamped solely between planar clamping surfaces of the redraw die and redraw clamping ring during redraw usage which provides for fabrication of a redrawn can body;

such a redrawn can body including a closed endwall, a cylindrical configuration side wall having a predetermined diameter which is in the range of about 15% to about 30% less than the diameter of the drawn work product, the redrawn can body having a uniform height extending from its closed end toward its axially opposite open end, flange metal extending about the full periphery of such redrawn can body about its open end, such flange metal being disposed at completion of such redrawn usage in a plane which is at or near to perpendicularly transverse to such common central axis of the redraw tooling, a side wall height which is greater than the height of the side wall of such drawn work product, and a compound curvilinear juncture between the closed end wall and redraw side wall having an interior surface area which is approximately equal to the surface area of the redraw punch curvilinear transition zone.

8. The apparatus of claim 7 in which the redraw clamping ring transition zone present a curvilinear surface formed about multiple radii of differing length measured in a radially oriented plane which includes the central axis of the redraw clamping ring.

9. The apparatus of claim 8 in which the redraw die has a curvilinear transition zone surface at both its cavity entrance and at its outer periphery, with each such curvilinear transition zone surface being formed about multiple radii of curvature of differing lengths measured in a radially oriented plane which includes such central axis.

10. The apparatus of claim 7 in which the redraw die and redraw clamping ring comprise sinter-hardened machineable tooling material selected from the group consisting of carbides, powdered metals, nitrides, ceramics, and combinations thereof.

11. Method for redrawing a one-piece cup-shaped work product drawn from high tensile strength double-reduced flat-rolled steel can stock precoated with organic coating and draw lubricant into a can body of decreased diameter and increased side wall height in relation to the diameter and side wall height, respectively, of the work product, comprising disposing a redraw die having a redraw cavity and a planar clamping surface on the exterior surface side of the cup-shaped work product in symmetrical relationship to the common central axis of the work product, disposing a redraw punch and a sleeve-like redraw clamping member having a planar clamping surface toward the interior surface side of such work product cup in symmetrical relationship to the common central axis of such work product, selecting the redraw punch for redraw usage to have a diameter providing for sheet metal and tooling clearance during relative movement of the redraw punch into the redraw cavity to decrease the work product side wall diameter by about 15% to 30%, disposing the redraw clamping member coaxially with the redraw punch during redraw usage in symmetrical relationship to the common central axis of the redraw punch and work product, selecting the redraw clamping ring peripheral side wall to have a diameter which is approximately equal to the internal diameter of the drawn work product side wall while allowing for tooling clearance, selecting the redraw clamping ring curvilinear transition zone at its peripheral side wall so that as projected during redraw usage onto a clamping surface plane which is perpendicularly transverse to the common central axis it occupies less than about 40% of a projection of the drawn work product compound curvilinear juncture between its endwall and side wall onto such clamping surface plane, providing for relative movement during redraw usage of the redraw clamping member and redraw punch parallel to such common central axis so as to initially reshape the configuration of such compound curvilinear juncture of the cup-shaped down work product to that of the compound curvilinear transition zone at the outer periphery of the redraw clamping member;

clamping drawn work product can stock radially outwardly of and contiguous to the redraw punch between the planar clamping surfaces of the redraw die and clamping ring while moving the redraw punch into the redraw cavity to form a redrawn can body having a closed endwall with a predetermined cross sectioned dimension which is between about 15% to 30% less than the corresponding dimension of the drawn work product, interrupting relative movement of the redraw punch into the redraw cavity so as to provide flange metal extending about the full periphery of the redrawn can body about its open end, such flange metal being disposed at completion of the redraw relative movement in a plane which is substantially perpendicularly transverse to such common central axis.

12. The method of claim 11 in which the clamping of the coated can stock is controlled so as to control tensioned stretching of the can body side wall during elongation of the work product side wall to avoid an increase in side wall gage over side wall height during such redraw usage.

13. The method of claim 11 for use as a final redraw during can body fabrication in which the redraw punch includes an endwall configuration providing for recessing a major portion of the redrawn can body planar endwall as initially shaped by the peripheral surface of the redraw punch, providing endwall profiling tooling at the distal end of the redraw die cavity for interacting with the redraw punch endwall configuration, and releasing such clamping of flange metal upon completion of the final redraw side wall elongation, and impressing the endwall profile in the final redraw station by relative movement between the redraw punch and the endwall profiling tooling.

14. A redraw die for redrawing a one-piece cup-shaped work product drawn from flat-rolled sheet metal can stock pre-coated with an organic coating and draw lubricant, such redraw die having a tubular configuration with an inner side wall and an outer side wall in symmetrical relationship with each other and a common central axis of the redraw die and a cup-shaped work product during redraw usage, an endwall presenting a planar clamping surface on such redraw die, curvilinear-surface transition zones unitary respectively with each of the inner and outer redraw die side walls and the redraw die planar clamping surface, each such transition zone having a curvilinear surface which at one of its arcuate ends is in tangential contact with the redraw die planar clamping surface and at its remaining arcuate end is in tangential contact with its respective redraw die side wall, forming a redraw die cavity entrance zone between the redraw die clamping surface and the redraw die inner side wall and a peripheral transition zone between the redraw die clamping surface and the redraw die outer side wall, and, in which each such redraw die curvilinear surface transition zone is formed about multiple radii of curvature of differing lengths as measured in a plane which includes such common central axis.

15. The redraw die of claim 14 in which the redraw die cavity has a tapered configuration of about one degree so as to increase the cross sectional area of the cavity defined by such inner side wall with increasing distance from the redraw die cavity entrance zone into such redraw die cavity.

16. The redraw die of claim 15 in which the curvilinear surface of the transition zone at the redraw die cavity entrance extends, as viewed in cross section in a plane which includes such common central axis, through an arc in excess of ninety degrees with such excess being equal to the amount of taper on the die cavity inner wall.

17. The redraw die of claim 16 in which the curvilinear surface of the redraw die cavity entrance zone as formed about multiple radii of curvature so as to increase the area of such curvilinear surface without increasing the projected area of such surface on a plane which is perpendicularly transverse to such common central axis providing for a more gradual curvature of the transition zone into such redraw cavity.

18. The redraw die of claim 14 formed from sinter-hardened machineable tooling material.

19. A redraw clamping tool for use in redrawing a cup-shaped work product drawn from flat-rolled sheet metal to decrease the cross sectional area of the cup-shaped work product in a plane perpendicularly transverse to its common central axis and increase its side wall height;

such clamping tool having an elongated sleeve-like configuration, symmetrical about its central longitudinal axis, with a working surface at one of the longitudinal ends;

such working surface comprising a planar clamping surface endwall lying in a plane which is at or near perpendicularly transverse to its central longitudinal axis at such longitudinal end of the clamping tool, an outer peripheral side wall surface and an inner side wall surface which are in symmetrical relationship to each other about such central axis, a transition zone surface between the planar surface endwall and the outer peripheral side wall surface, such transition zone surface being curvilinear as viewed in cross section in a plane which includes such central axis, and in tangential contact with the planar endwall surface and the outer peripheral side wall surface, such transition zone surface presenting a composite of a plurality of curvilinear surfaces formed about at least two radii of curvature of different lengths such that a projection of such composite of curvilinear surfaces transition zone onto a plane which is perpendicularly transverse to such central axis occupies a less cross sectional dimension in such plane than the maximum radius of curvature utilized in forming such transition zone surface.

20. The redraw clamping tool of claim 19 in which such composite of a plurality of curvilinear surfaces utilizes two radii of curvature including a larger radius and a smaller radius, and such composite surface includes a pair of curvilinear surfaces formed about such larger radius of curvature and a single curvilinear surface formed about such smaller radius of curvature, with one of such pair of larger radius of curvature surfaces being in tangential contact with the planar endwall clamping surface and the remaining surface of such pair of larger radius of curvature surfaces being in tangential contact with the peripheral side wall surface, and such smaller radius of curvature surface is located intermediate of and in tangential contact with such pair of larger radius of curvature surfaces.

21. The redraw clamping tool of claim 20 in which such smaller radius of curvature is approximately one-half the length of such larger radius of curvature.

22. The redraw clamping tool of claim 19 formed from pulverant material sinter-hardened into a machineable tool configuration.

23. The redraw clamping tool of claim 19 formed from sinter-hardened machineable tooling material selected from the group consisting of carbides, powdered metals, nitrides, ceramics and combinations thereof.

* * * * *